US012162578B2

(12) United States Patent
Kemp et al.

(10) Patent No.: US 12,162,578 B2
(45) Date of Patent: Dec. 10, 2024

(54) HIGH-CAPACITY LIGHTWEIGHT VARIABLE BUOYANCY SYSTEM

(71) Applicant: BAE SYSTEMS Information and Electronic Systems Integration Inc., Nashua, NH (US)

(72) Inventors: Mathieu P. Kemp, Amherst, NH (US); Christopher M. Romano, Marshfield, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 225 days.

(21) Appl. No.: 17/869,106

(22) Filed: Jul. 20, 2022

(65) Prior Publication Data

US 2024/0025525 A1 Jan. 25, 2024

(51) Int. Cl.
*B63G 8/22* (2006.01)
*B63G 8/24* (2006.01)

(52) U.S. Cl.
CPC ..... *B63G 8/22* (2013.01); *B63G 8/24* (2013.01)

(58) Field of Classification Search
CPC ... B63G 8/00; B63G 8/14; B63G 8/22; B63G 8/24
USPC ..... 114/312, 313, 317, 331, 333
See application file for complete search history.

(56) References Cited

U.S. PATENT DOCUMENTS

| | | | | |
|---|---|---|---|---|
| 1,188,842 | A | 6/1916 | Schrumpf | |
| 9,272,756 | B1 | 3/2016 | Thomson | |
| 9,308,977 | B2 | 4/2016 | Andersen | |
| 9,776,694 | B2 | 10/2017 | Oledzki | |
| 10,081,416 | B2 | 9/2018 | Elder | |
| 10,322,782 | B1 | 6/2019 | Brown | |
| 10,569,839 | B1 | 2/2020 | Thomson | |
| 11,155,328 | B1 | 10/2021 | Hong | |
| 2011/0297071 | A1 | 12/2011 | Hudson | |
| 2012/0289103 | A1* | 11/2012 | Hudson | B63G 8/22 290/1 R |
| 2013/0239870 | A1 | 9/2013 | Hudson | |
| 2016/0201402 | A1 | 7/2016 | McCleary et al. | |

FOREIGN PATENT DOCUMENTS

| | | | |
|---|---|---|---|
| AU | 2020299129 | B2 | 5/2022 |
| CN | 207647868 | U | 7/2018 |
| DE | 102008024815 | B3 | 7/2009 |
| EP | 2130760 | B1 | 12/2010 |

(Continued)

OTHER PUBLICATIONS

International Search Report, PCT/US23/27582, mailed Mar. 22, 2024, 10 pages.

(Continued)

*Primary Examiner* — Daniel V Venne
(74) *Attorney, Agent, or Firm* — Maine Cernota & Curran; Gary McFaline

(57) ABSTRACT

Techniques and architectures are disclosed for a system capable of creating large changes in buoyancy that can be incorporated into underwater vehicles, embodiments of the system utilizing edge-welded, metal bellows disposed within a pressure vessel to balance a pressure differential across the bellows while using the bellows to displace fluid and thereby alter the buoyancy of a vehicle on which the system is disposed.

20 Claims, 8 Drawing Sheets

(56) References Cited

FOREIGN PATENT DOCUMENTS

| | | | |
|---|---|---|---|
| GB | 2430471 | A | 3/2007 |
| WO | 2011069808 | A2 | 6/2011 |
| WO | 2018067738 | A1 | 4/2018 |

OTHER PUBLICATIONS

Shibuya, K et al. New Volume Change Mechanism Using Metal Bellows for Buoyancy Control Device of Underwater Robots. International Scholarly Research Notices, vol. 2013, Article ID 541643. Hindawi Publishing Corporation, 2013. pp. 1-7. online. Jun. 7, 2022. <https://doi.org/10.5402/2013/541643> <DOI: 10.5402/2013/541643>.

Ranganathan, T et al. Design and Analysis of Cascaded Variable Buoyancy Systems for Selective Underwater Deployment. Proceedings of the 13th International Conference on Informatics in Control, Automation and Robotics—vol. 2: ICINCO. SciTePress, 2016. pp. 319-326. online. Jun. 7, 2022. <https://www.scitepress.org/Papers/2016/59799/pdf/index.html> <DOI: 10.5220/0005979903190326>.

* cited by examiner

HIGH-CAPACITY LIGHTWEIGHT VARIABLE BUOYANCY SYSTEM

FIELD OF THE DISCLOSURE

The following disclosure relates generally to submersible vehicles, and, more specifically, to submersible vehicles having a need for a wide range of buoyancy configurations.

BACKGROUND

New Underwater Vehicle (UV), especially Unmanned Underwater Vehicle (UUV) (both may also be referred to herein as submersible vehicles, generally), mission sets require much larger buoyancy changes than the capabilities of existing technology. More specifically regarding UUVs, most are ballasted to be net positively buoyant, meaning they float on the surface in the absence of external forces and require some form of propulsion to dive and stay underwater. Net buoyancy is the difference between the vehicle's dry weight and the weight of the water the vehicle displaces. Typically, a UUV is ballasted to about 1% of its dry weight, meaning a 1% change in the vehicles weight will cause it to go neutrally buoyant, or "hover" in the water column.

Because such vehicles are ballasted to be net positively buoyant, long-term hibernation, or loitering, of the vehicle within a water column, at a static depth, is not possible, since some energy is required to counteract the positive buoyancy, although such a feature is increasingly desirable. Constantly powering an active propulsion system to fight the buoyant force is currently the most common way for such a vehicle to loiter, but this is not power efficient, and will eventually deplete onboard power reserves. In short, having the ability to affect a significant buoyancy change, while using no or minimal power on an ongoing basis, is needed to hibernate such a vehicle for indefinite periods.

Also, a further development in UUV usage that is driving the need for a high-capacity, lightweight, variable buoyancy system is the increasingly common deployment of relatively large appendages, such as RF antennas, above the waterline. Once features of a UUV are raised out of the water, the displacement of those features is no longer part of the buoyancy equation. This means that the vehicle becomes net heavier once those appendages are deployed and net lighter once they are submerged, requiring a larger buoyancy range than would otherwise be the case. Either a change in vehicle mass or the deployment of an opposing appendage or appendages with same volume below the waterline is needed to keep the vehicle stable at the surface using current technology, however, in the latter case, this additional opposing appendage(s) add(s) additional weight, requiring additional buoyancy change when fully submerged, while adding weight requires additional ballast and decreases overall performance.

Furthermore, any changes in the density of the water will affect the buoyant force. For example, the buoyant force of saltwater is significantly greater than the buoyant force of freshwater, because saltwater is denser than freshwater. If a UUV needs to traverse from saltwater to freshwater—e.g. travel into an estuary or up a river from deployment in the ocean—the net buoyancy of that vehicle would change and the vehicle may become net negatively buoyant. Another example is traversing near the polar ice caps. Since ice is freshwater, as it melts into the ocean it creates a mix of salt and freshwater, which changes its density and resultant buoyant force on the vehicle. Current systems limit the ability of UUVs to traverse between such bodies of water, which is increasingly required as part of a mission set.

Existing ballast tanks, such as those used on submarines, rely on large air compressors to pressurize ballast tanks, thereby blowing out water contained therein, affecting a ballast change. Notably, this requires the vehicle to periodically come to the surface to recharge those tanks. Additionally, the air compressors needed by such a system are large, loud, and heavy, requiring additional ballast, limiting the space available for other components, and alerting anyone listening to the presence of the vehicle. It would therefore be highly weight inefficient, as well as pose a security risk in some instances, to fit a ballast thank, air compressor, air holding tank, regulator, valves and air lines into a relatively small UV, such as a typical UUV. Moreover, any weight that is added to a UUV without an attendant increase in ballast requires more water displacement to counter that weight to achieve neutral buoyancy. This requires the vehicle to be longer, which adds weight, requiring even more ballast.

While externally mounted, formed bellows, such as hydroformed bellows, have been used on very small research UUVs for buoyancy control, these have a very limited stroke potential, typically less than 10% of their free length, which limits their displacement capabilities and, therefore, ability to vary buoyancy over a wide range. While edge-welded metal bellows are known, and support a much longer stroke, over 90% of their free length in compression in some cases, their pressure-carrying capability is limited, limiting their use to low differential-pressure applications, e.g. vehicles that are intended for use only in relatively shallow water.

What is needed, therefore, is a high capacity, yet lightweight, variable buoyancy system that is suitable for use at significant depth and that could be outfitted to a UV, especially a small UV, such as a UUV, allowing it to hibernate, deploy relatively large appendages, such as RF antennas, above the waterline, and traverse between bodies of water having very different salinity while minimizing energy usage to maintain a desired vertical position within a water column, noise output, and weight, without requiring the UV to periodically surface to recharge the variable buoyancy system.

SUMMARY

Embodiments described herein use seawater to affect a mass change of a submersible vehicle. More specifically, by including a flooded volume internal to the vehicle and pumping seawater into this flooded volume, we are affecting a chance in mass, rather than a change in displacement, to achieve a buoyancy change. While some existing systems carry their own hydraulic oil to fill a bladder, carrying that oil adds significant weight to the vehicle. By placing the flooded volume internal to the submersible vehicle and pumping seawater into the flooded volume, a chance in mass, not displacement, is achieved, causing a buoyancy change.

Also, approaches that use changes in displacement to affect buoyancy changes typically require wet sections of the submersible vehicle, which add vehicle length and weight without the benefit of displacement. By having modular dry sections of the submersible vehicle where embodiments of the present disclosure are housed, those modules provide a net weight decrease of the vehicle, meaning the modules themselves displace more than they weigh dry.

One embodiment of the present disclosure provides a high capacity, yet lightweight, variable buoyancy system that uses edge-welded metal bellows in combination with an environment in which the pressure differential across the bellows is controlled and limited to the differential-pressure carrying capability of the bellows. Because edge welded metal bellows have very high displacement to length ratios, relative to formed bellows, such embodiments provide significant performance benefits over the prior art, while remaining light-weight and offering a wide range of buoyancy.

In embodiments, a method of altering buoyancy using the high capacity, lightweight, variable buoyancy system comprises pumping a fluid in which the UV is submerged, in embodiments seawater, into a space around the bellows OR into the bellows themselves, thereby changing the effective ballast, with the former being referred to herein as low pressure reservoir embodiment and the latter as a high pressure accumulator embodiment.

In embodiments of the former, low pressure reservoir embodiment, the bellows contain trapped air or gas, in embodiments an inert gas, such as Argon.

In embodiments of the latter, high pressure accumulator embodiment, an accumulator housing in which the bellows are contained contains high pressure air or gas, in embodiments an inert gas, such as Argon.

The aforementioned embodiments keep the differential pressure acting on the edge-welded metal bellows below a threshold level, allowing their use to control buoyancy across a wide range in environments that would typically place too large of a pressure differential across the bellows, resulting in their failure.

One embodiment of the present disclosure provides a variable-buoyancy system, the system comprising: at least one bellows module, the at least one bellows module comprising: a pressure vessel comprising a flooded volume and at least one bellows; and a pump in operative communication with the flooded volume and in further operative communication with an environment external to the at least one bellows module via a fluid passage between the environment external to the at least one bellows module and the flooded volume in which a valve configured to allow the fluid passage to be opened or sealed is disposed, wherein the at least one bellows comprises one moveable end and one fixed end, the fixed end being affixed to an interior of the pressure vessel, wherein an interior of the at least one bellows defines a volume sealed from the flooded volume, wherein the pump and valve are configured to convey a fluid between the environment external to the at least one bellows module and the flooded volume, wherein the conveyance of the fluid from the environment external to the at least one bellows module to the flooded volume is configured to cause the at least one bellows to contract, wherein the conveyance of the fluid from the flooded volume to the environment external to the at least one bellows module is configured to cause the at least one bellows to expand, and wherein the at least one bellows is an edge-welded metal bellows.

Another embodiment of the present disclosure provides such a variable-buoyancy system, further comprising a sensor disposed within the at least one bellows, the sensor configured to measure an expansion of the at least one bellows.

A further embodiment of the present disclosure provides such a variable-buoyancy system wherein the bellows module further comprises a control module configured to receive information from the sensor and to control the pump and the valve in response to a control signal.

Yet another embodiment of the present disclosure provides such a variable-buoyancy system wherein the bellows module further comprises a filter disposed between the valve and the environment external to the at least one bellows module.

A yet further embodiment of the present disclosure provides such a variable-buoyancy system wherein the at least one bellows comprises a plurality of bellows.

Still another embodiment of the present disclosure provides such a variable-buoyancy system wherein the at least one bellows module comprises a plurality of bellows modules.

A still further embodiment of the present disclosure provides such a variable-buoyancy system disposed on an underwater vehicle, wherein each of the plurality of bellows modules is located on the underwater vehicle such that independent control thereof provides for pitch and/or heave control of the underwater vehicle.

Even another embodiment of the present disclosure provides such a variable-buoyancy system wherein the plurality of modules are located and oriented to allow for independent heave and pitch control.

An even further embodiment of the present disclosure provides such a variable-buoyancy system wherein the interior of the at least one bellows is pressurized using a source of compressed gas, with the pressure being varied during use, vented to an environment internal to an underwater vehicle on which the at least one bellows module is disposed, or charged to a specific pressure, using a compressed gas, and sealed.

A still even another embodiment of the present disclosure provides such a variable-buoyancy system wherein the at least one bellows is manufactured from a material selected from the group of materials consisting of Hastelloy®, Inconel®, titanium, stainless steel, AM350, and 316L.

One embodiment of the present disclosure provides a variable-buoyancy system, the system comprising: at least one bellows module, the at least one bellows module comprising: a pressure vessel comprising at least one bellows, wherein an interior of the at least one bellows comprises a flooded volume; and a pump in operative communication with the flooded volume and in further operative communication with an environment external to the at least one bellows module via a fluid passage between the environment external to the at least one bellows module and the flooded volume in which a valve configured to allow the fluid passage to be opened or sealed is disposed, wherein the at least one bellows further comprises one moveable end and one fixed end, the fixed end being affixed to an interior of the pressure vessel, wherein the pump and valve are configured to convey a fluid between the environment external to the at least one bellows module and the flooded volume, wherein the conveyance of the fluid from the environment external to the at least one bellows module to the flooded volume is configured to cause the at least one bellows to expand, wherein the conveyance of the fluid from the flooded volume to the environment external to the at least one bellows module is configured to cause the at least one bellows to contract, and wherein the at least one bellows is an edge-welded metal bellows.

Another embodiment of the present disclosure provides such a variable-buoyancy system further comprising a sensor disposed within the pressure vessel, the sensor configured to measure an expansion of the at least one bellows.

A further embodiment of the present disclosure provides such a variable-buoyancy system wherein the bellows module further comprises a control module configured to receive information from the sensor and to control the pump and the valve in response to a control signal.

Yet another embodiment of the present disclosure provides such a variable-buoyancy system wherein the bellows module further comprises a filter disposed between the valve and the environment external to the at least one bellows module.

A yet further embodiment of the present disclosure provides such a variable-buoyancy system wherein the at least one bellows comprises a plurality of bellows.

Still another embodiment of the present disclosure provides such a variable-buoyancy system wherein the at least one bellows module comprises a plurality of bellows modules.

A still further embodiment of the present disclosure provides such a variable-buoyancy system disposed on an underwater vehicle wherein each of the plurality of bellows modules is located on the underwater vehicle such that independent control thereof provides for pitch and/or heave control of the underwater vehicle.

Even another embodiment of the present disclosure provides such a variable-buoyancy system wherein the interior of the pressure vessel is pressurized using a source of compressed gas, with the pressure being varied during use, vented to an environment internal to an underwater vehicle on which the at least one bellows module is disposed, or charged to a specific pressure, using a compressed gas, and sealed.

An even further embodiment of the present disclosure provides such a variable-buoyancy system wherein the at least one bellows is manufactured from a material selected from the group of materials consisting of Hastelloy®, Inconel®, titanium, stainless steel, AM350, and 316L.

One embodiment of the present disclosure provides a variable-buoyancy system, the system comprising: at least one bellows module, the at least one bellows module comprising: a wet side, open to an external environment of the at least one bellows module; a dry side, sealed from the external environment of the at least one bellows module; at least one bellows disposed in a guide tube; and at least one actuator operatively coupled to each of the at least one bellows, wherein each of the at least one actuators is configured to expand and/or contract at least one bellows in response to a control signal, wherein the actuators are disposed in the dry side of the at least one bellows module, wherein an interior volume of the at least one bellows is open to the dry side of the at least one bellows module, wherein the at least one actuator is configured to expand and/or contract the at least one bellows in response to a control signal, and wherein the at least one bellows is an edge-welded metal bellows.

Implementations of the techniques discussed above may include a method or process, a system or apparatus, a kit, or a computer software stored on a computer-accessible medium. The details or one or more implementations are set forth in the accompanying drawings and the description below. Other features will be apparent from the description and drawings, and form the claims.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

DETAILED DESCRIPTION

Figure 1A:
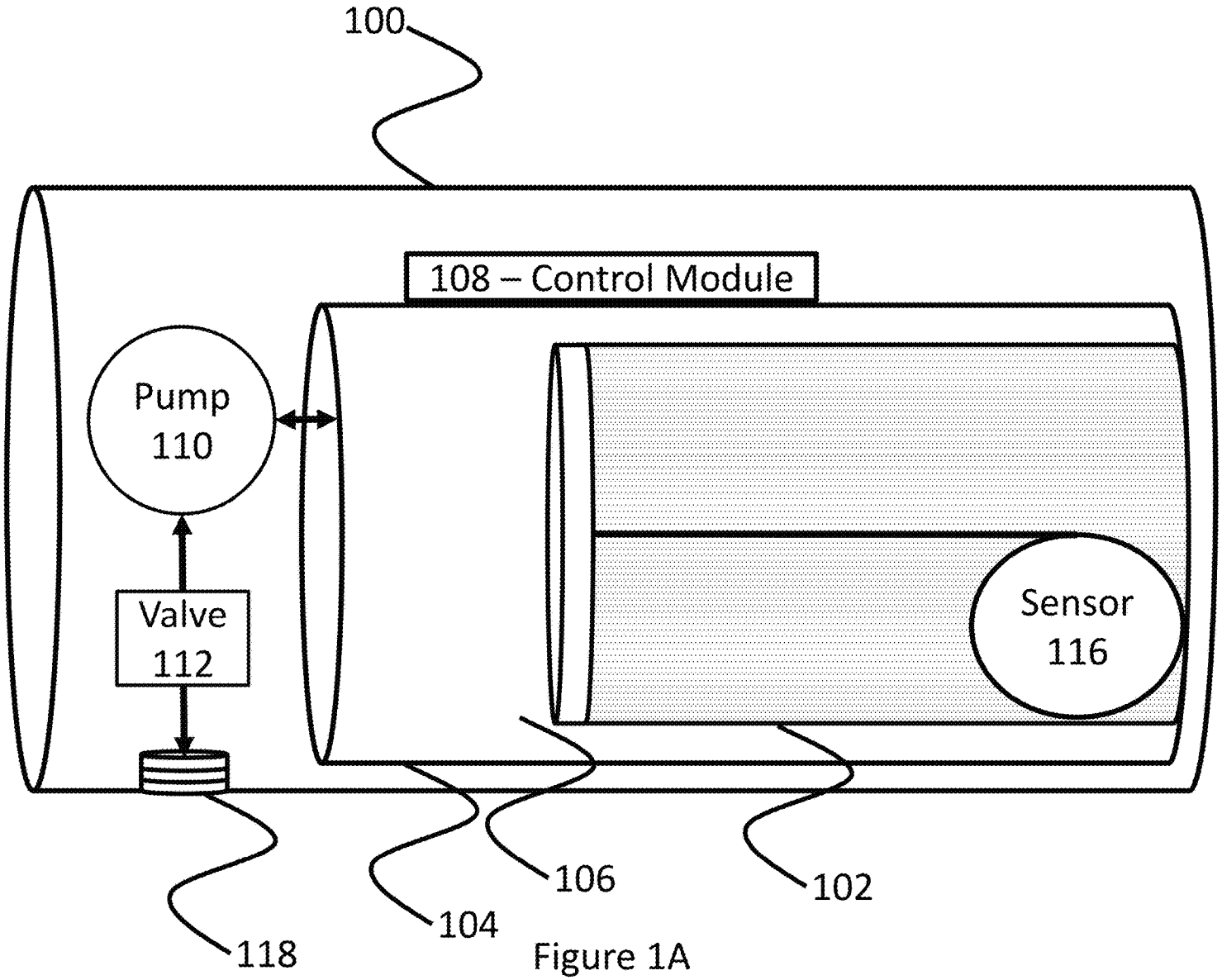
FIG. 1A is a schematic showing a bellows module, which is herein referred to as a low-pressure reservoir embodiment, with the bellows in an expanded state, in accordance with embodiments of the present disclosure.

This disclosure relates to systems capable of creating large changes in buoyancy that can be incorporated into Underwater Vehicles (UVs) 400, especially Unmanned Underwater Vehicles (UUVs) 400, both of which may be referred to herein generally as submersible vehicles 400. In embodiments, this large range of buoyancy is achieved using metal bellows 102, in embodiments edge welded metal bellows 102. Metal bellows 102 provide a flexible, hermetic seal that will not leak and provide significant advantages over elastomeric seals, diaphragms, and bladders, which have a tendency to leak, especially when in contact with low lubricity fluids, such as seawater, as is commonly encountered by UVs. This is critical, since any leakage past an elastomeric seal or degradation of a bladder would be catastrophic, likely causing loss of the vehicle.

Because metal bellows 102 can expand and contract while taking large hydrostatic loads, metal bellows 102 achieve the same displacement for less weight, and therefore produce more displacement at equal weight, relative to elastomeric seals, diaphragms, and bladders.

Furthermore, in embodiments, bellows 102 allow a consistent, reliable, and direct measurement of the amount of the ballast provided thereby to be readily obtained. More specifically, since bellows 102 act analogous to a piston, without the use of a sliding elastomeric seal(s), the position of a moving end of the bellows 102 can be directly measured by a number of conventional methods, such as through the use of a sensor 116. For example, in embodiments, the sensor 116 is a draw wire potentiometer that is operatively connected to a bellows 102, in embodiments providing a direct measure the amount of fluid in a flooded volume 106 that, in embodiments, surrounds the bellows 102. An elastomeric bladder does not provide this ability and fluid levels must instead be inferred from other sensors in the system, such as flowmeters, pressure gauges, or the behavior of the vehicle itself.

In embodiments, the metal bellows 102 are edge-welded, metal bellows 102, which typically are able to maintain a more consistent wall thickness, overall tighter tolerances, and superior performance, compared to formed bellows 102. Additionally, the significantly higher stroke capability of an edge welded metal bellows 102, relative to formed bellows 102, which is discussed in the present disclosure's background section, allows for a smaller and lighter form factor than a formed bellows 102, while providing a wider range of ballast capabilities.

More specifically, embodiments of the present disclosure use edge-welded, metal bellows 102 to achieve large displacements and high weight efficiency.

In one embodiment, the inside of the metal bellows 102 is dry and an actuator 300, in embodiments a linear actuator 300, is configured to expand and contract the metal bellows 102 into a flooded volume 106.

Figure 4A:
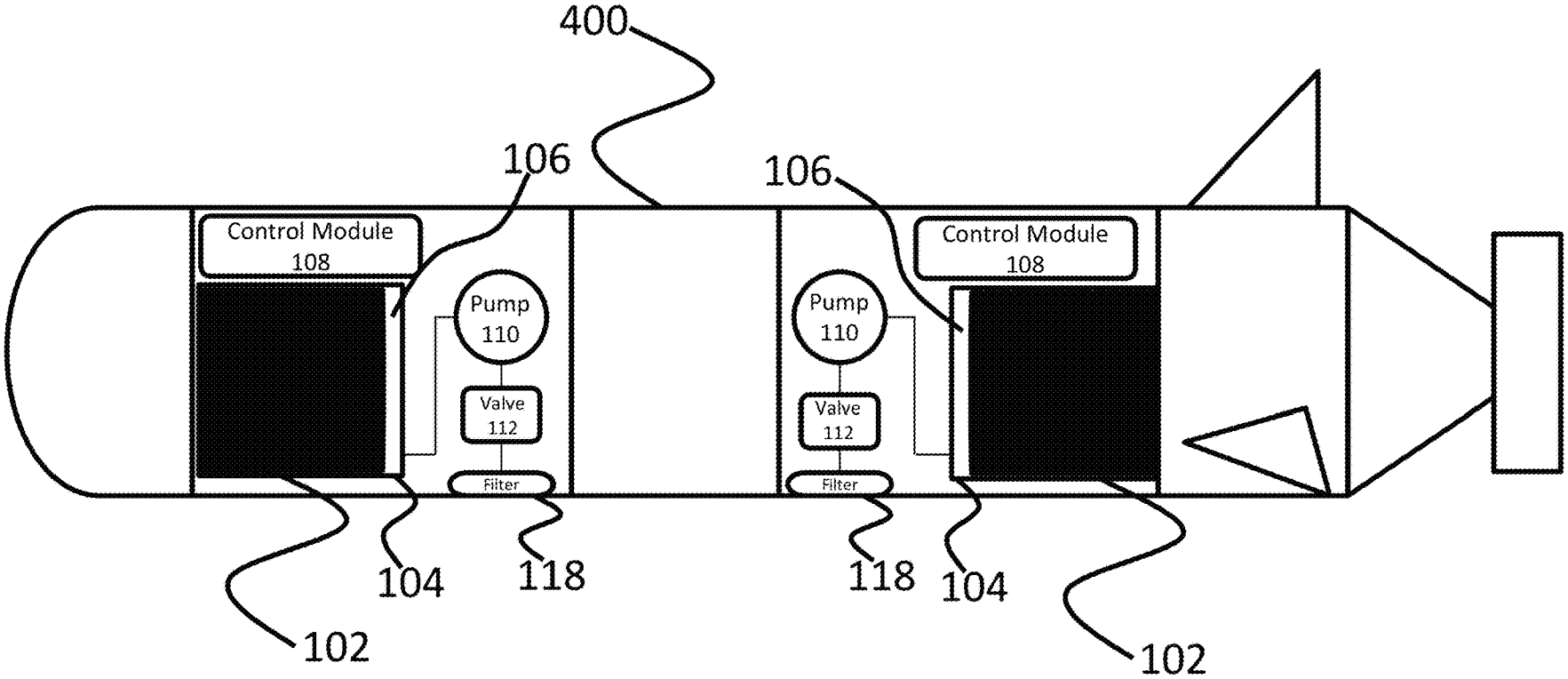
FIG. 4A is a schematic showing a submersible vehicle including a low-pressure reservoir embodiment of a bellows module, with the bellows in an expanded state, in accordance with embodiments of the present disclosure.
Figure 4B:
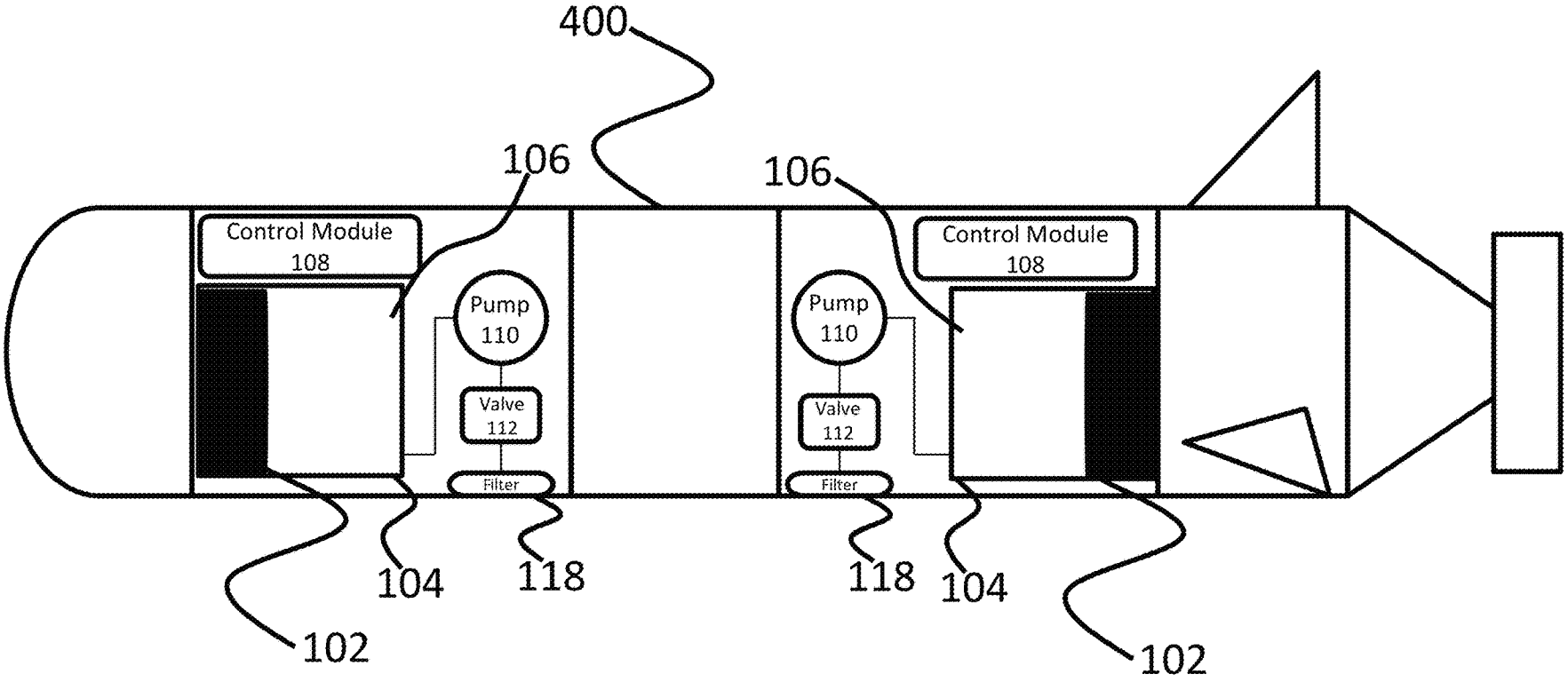
FIG. 4B is a schematic showing a submersible vehicle including a low-pressure reservoir embodiment of a bellows module, with the bellows in a collapsed state, in accordance with embodiments of the present disclosure These and other features of the present embodiments will be understood better by reading the following detailed description, taken together with the figures herein described. The accompanying drawings are not intended to be drawn to scale. For purposes of clarity, not every component may be labeled in every drawing.

In a second embodiment, multiple bellows 102, each operatively connected to at least one actuator 300, are combined to form a bellows module 100 to achieve more displacement, and multiple bellows modules 102 are positioned on a UV 400, in embodiments a UUV 400, to achieve independent heave and pitch control. FIGS. 4A and 4B provide exemplary positions of the multiple bellows modules 102.

In a third embodiment, an interior volume of the metal bellows 102 defines a flooded volume 106 and is filled with a fluid, in embodiments water or seawater obtained from an environment external to the bellows module 100, while a pressure vessel 104 in which the bellows is disposed is filled with compressed gas. In such embodiments, a pump 110 and valve 112 are used to change the volume of water contained within the bellows 102. Embodiments also include a filter 118 configured to filter the fluid being pumped from the external environment of the bellows module 100.

In a fourth embodiment, an interior volume of the bellows 102 is filled with air, and a pump 110 and valve 112 are used to change the displacement of the bellows 102 by introducing a fluid into, or evacuating a fluid out of a, a pressure vessel 104 in which the bellows 102 is disposed, the interior volume of the pressure vessel 104 comprising a flooded volume 106 in such embodiments.

In embodiments, the bellows module 100 is a standardized design, allowing it to be used interchangeably with various current underwater platforms.

Figure 1B:
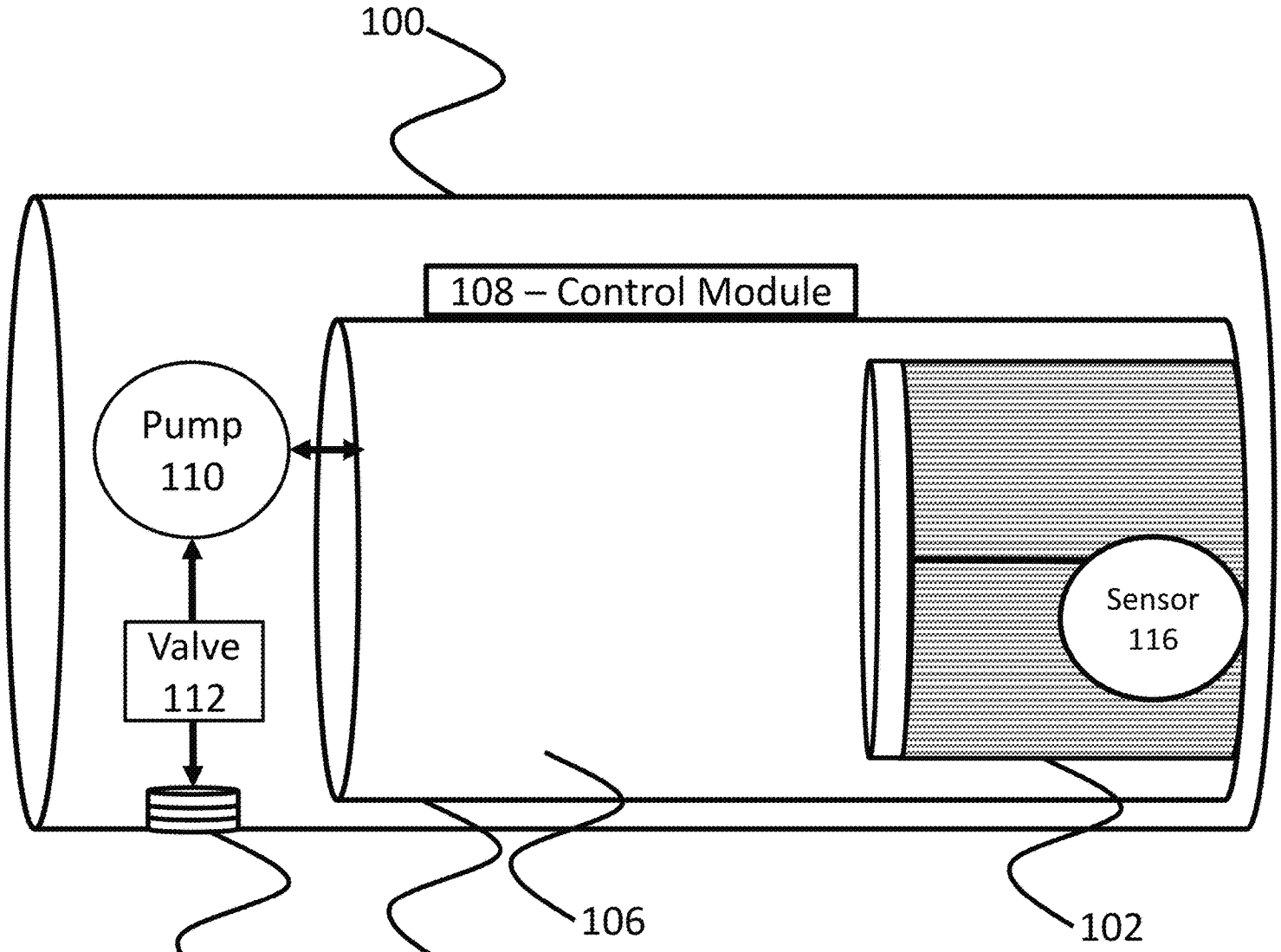
FIG. 1B is a schematic showing a bellows module, which is herein referred to as a low-pressure reservoir embodiment, with the bellows in a collapsed state, in accordance with embodiments of the present disclosure.

Now referring specifically to FIGS. 1A and 1B, which differ only in that FIG. 1A shows the bellows 102 in an expanded state while FIG. 1B shows the bellows 102 in a contracted state, a low-pressure reservoir embodiment of the bellows module 100 is depicted. More specifically, the bellows module 100 comprises at least one bellows 102 disposed in a pressure vessel 104. An interior of the pressure vessel 104 comprises a flooded volume 106 into which fluid is pumped and/or removed using a pump 110 and valve 112 arrangement, with at least one pump 110, via at least one valve 112, in operative communication with the flooded volume 106 also being in communication with an external environment of the bellows module 100. Since the bellows module 100 is intended for use on UVs and UUVs, this places the at least one pump 110 in communication with a ready source of fluid, typically either fresh or salt water.

In such embodiments, an interior volume of the bellows 102 is kept dry and may be actively pressurized using a source of compressed gas, such as air, or by venting the interior volume of the bellows 102 to a dry portion of a UV on which it is disposed. In embodiments, the interior volume of the bellows 102 is charged to a specific pressure, using a compressed gas, and sealed. Such an arrangement results in the bellows 102 being biased towards an expanded state, with fluid pumped into the flooded volume 106 being used to collapse the bellows 102.

In embodiments, the pump 110 and valve 112 are controlled by a control module 108 that comprises a processor and non-transitory storage medium configured to cause the pump 110 to pump and/or valve 112 to open or close, resulting in the expansion or contraction of the bellows 102. In embodiments, such control is enacted in response to a control signal, which may be generated by a sensor 116 in response to environmental conditions, mechanical conditions of the bellows module or UV, control signals provided by a user, who may be a remote user of a UUV to which the bellows module 100 is affixed, or other type of signal, whether wired or wireless, as would be known to one of ordinary skill in the art.

In embodiments, the at least one pump 110, via the at least one valve 112, is in communication with an external environment of the bellows module 100 via a filter 118 that is configured to block debris, particulate, and/or other undesirable elements from entering the bellows module 100.

In embodiments, a sensor 116, such as a draw wire potentiometer, is operatively connected to at least one bellows 102, providing a reliable measure of fluid level in the pressure vessel 104 and therefore of the ballast provided by the bellows module 100.

In embodiments, the sensor 116 is used by the control module 108 to implement closed-loop feedback control during expansion and/or contraction of the at least one bellows 102.

Figure 2A:
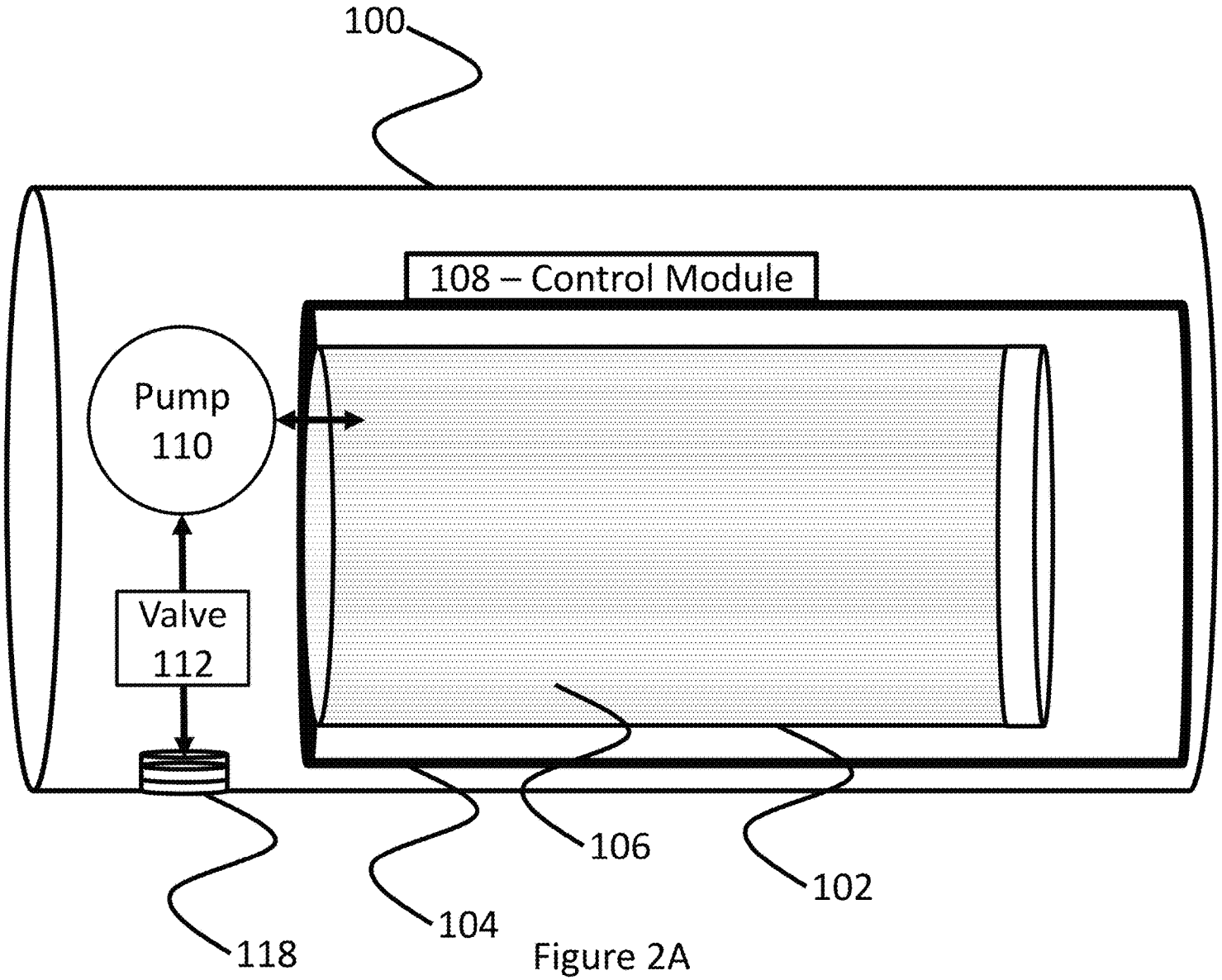
FIG. 2A is a schematic showing an embodiment of a bellows module, which is herein referred to as a high-pressure accumulator embodiment, with the bellows in an expanded state, in accordance with embodiments of the present disclosure.
Figure 2B:
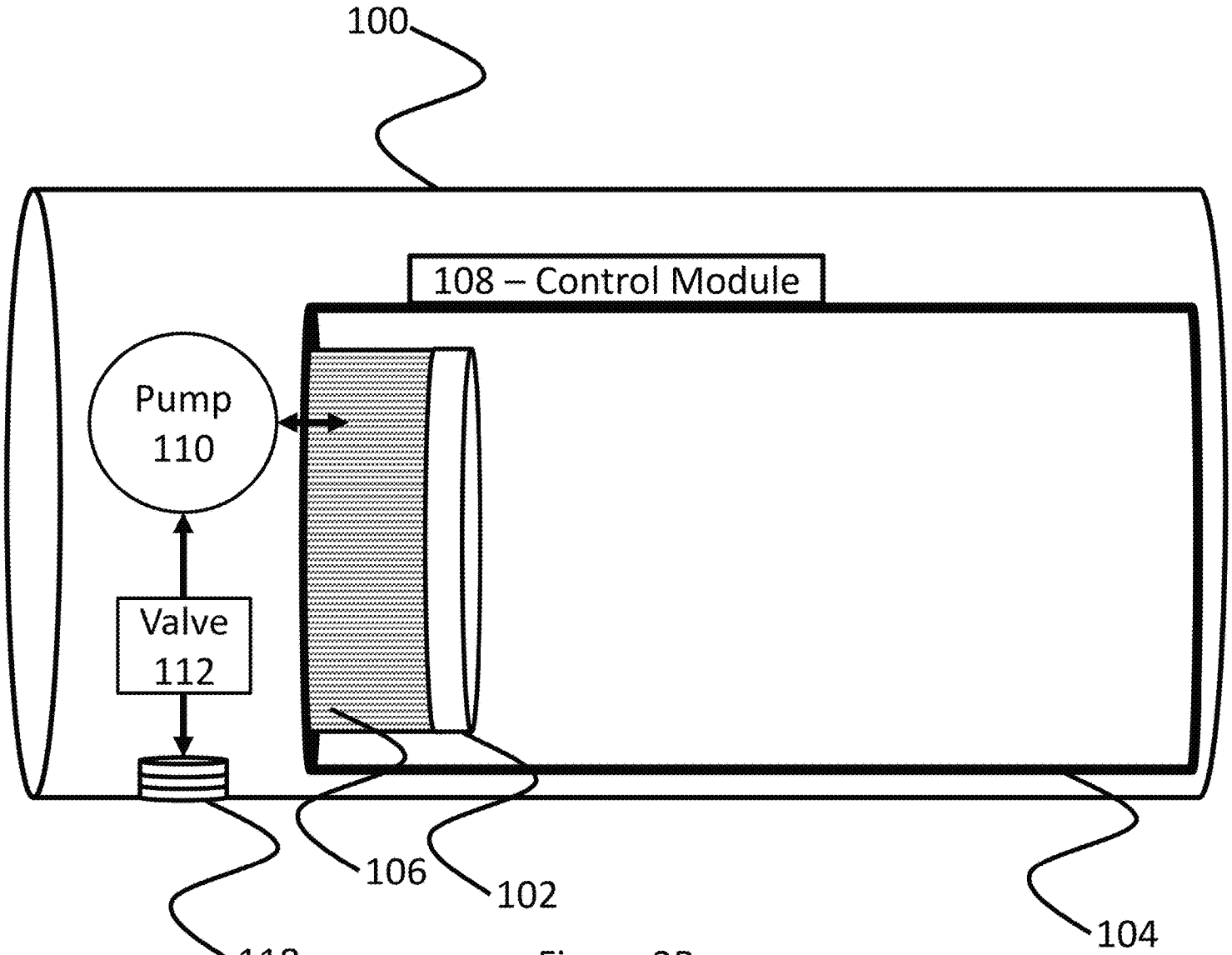
FIG. 2B is a schematic showing an embodiment of a bellows module, which is herein referred to as a high-pressure accumulator embodiment, with the bellows in an expanded state, with the bellows in a collapsed state, in accordance with embodiments of the present disclosure.

Now referring specifically to FIGS. 2A and 2B, which differ only in that FIG. 2A shows the bellows 102 in an expanded state while FIG. 2B shows the bellows 102 in a contracted state, a high-pressure accumulator embodiment of the bellows module 100 is depicted. More specifically, the bellows module 100 comprises at least one bellows 102 disposed in a pressure vessel 104. An interior of the at least one bellows 102 comprises a flooded volume 106 into which fluid is pumped and/or removed using a pump 110 and valve 112 arrangement, with at least one pump 110, via at least one valve 112, in operative communication with the flooded volume 106 also being in communication with an external environment of the bellows module 100. Since the bellows module 100 is intended for use on UVs and UUVs, this places the at least one pump 110 in communication with a ready source of fluid, typically either fresh or salt water.

In such embodiments, an interior volume of the pressure vessel 104 is kept dry and may be actively pressurized using a source of compressed gas, such as air or helium or by venting the interior volume of the pressure vessel 104 to a UV on which it is disposed. In embodiments, the interior volume of the pressure vessel 104 is charged to a specific pressure, using a compressed gas, and sealed. Such an arrangement results in the bellows 102 being biased towards a contracted state by the pressurized gas, with fluid pumped into the flooded volume 106 being used to expand the bellows 102.

In embodiments, the pump 110 and valve 112 are controlled by a control module 108 that comprises a processor and non-transitory storage medium configured to cause the pump 110 to pump and/or valve 112 to open or close, resulting in the expansion or contraction of the bellows 102. In embodiments, such control is enacted in response to a control signal, which may be generated by a sensor in response to environmental conditions, mechanical conditions of the bellows module or UV, control signals provided by a user, who may be a remote user of a UUV to which the bellows module 100 is affixed, or other type of signal, whether wired or wireless, as would be known to one of ordinary skill in the art.

In embodiments, the at least one pump 110, via the at least one valve 112, is in communication with an external environment of the bellows module 100 via a filter 118 that is configured to block debris, particulate, and/or other undesirable elements from entering the bellows module 100.

Figure 3A:
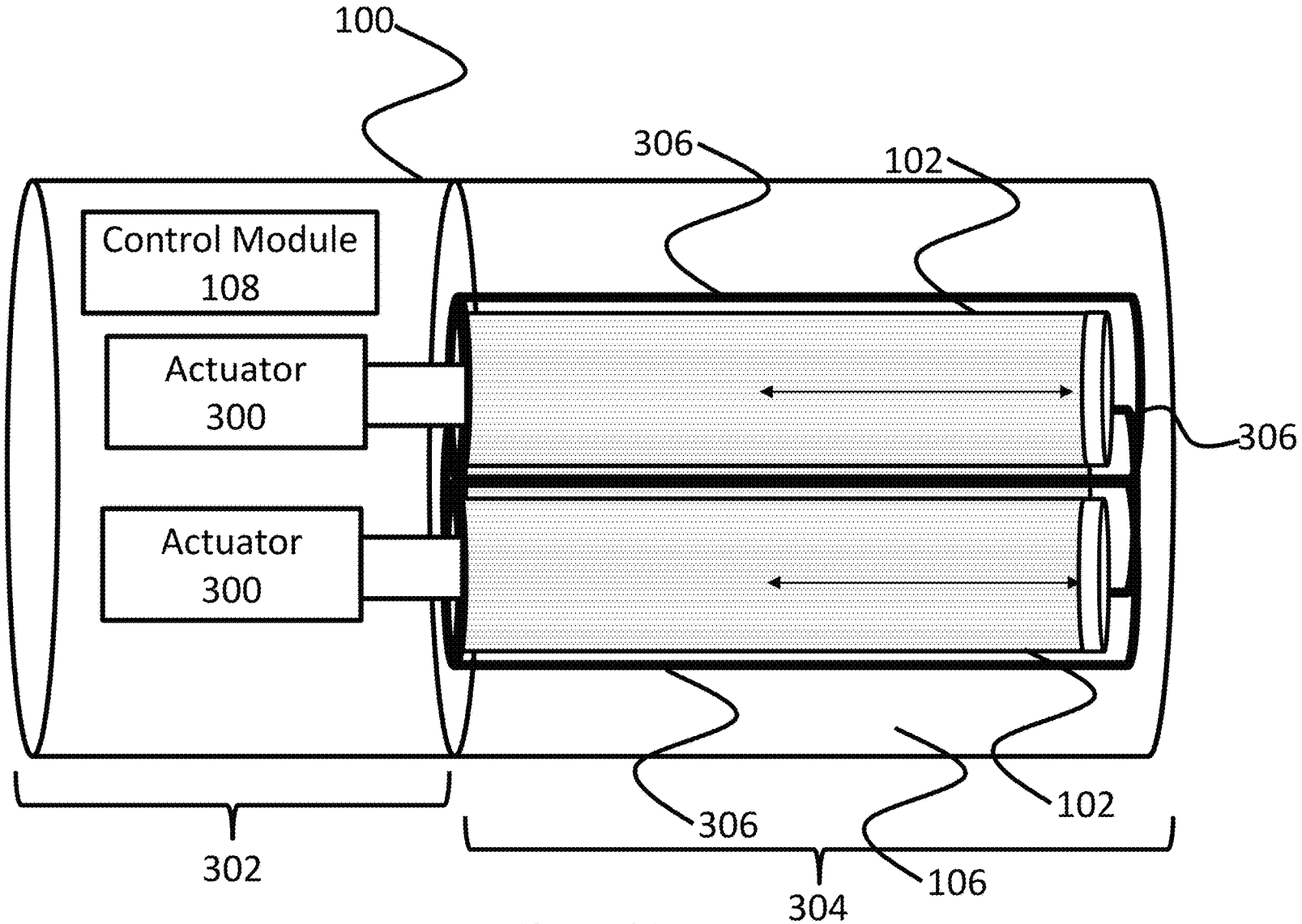
FIG. 3A is a schematic showing an embodiment of a bellows module, which is herein referred to as a bellows piston embodiment, with the bellows in an expanded state, in accordance with embodiments of the present disclosure.
Figure 3B:
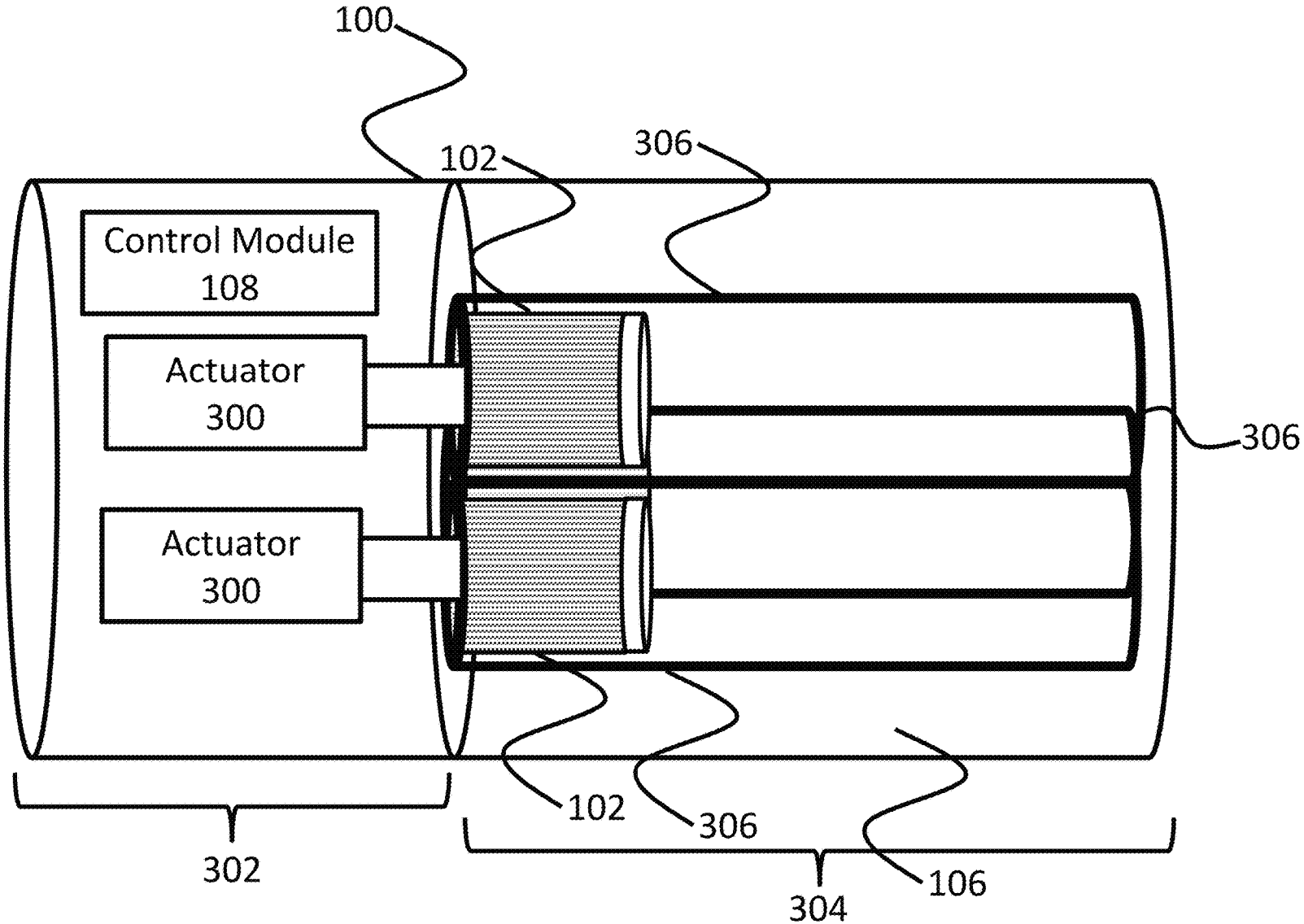
FIG. 3B is a schematic showing an embodiment of a bellows module, which is herein referred to as a bellows piston embodiment, with the bellows in a collapsed state, in accordance with embodiments of the present disclosure.

Now referring specifically to FIGS. 3A and 3B, which differ only in that FIG. 3A shows the bellows 102 in an expanded state while FIG. 3B shows the bellows 102 in a contracted state, a bellows piston embodiment of the bellows module 100 is depicted. More specifically, the bellows module 100 comprises at least one bellows 102 disposed therein, the at least one bellows 102 having a fixed open end in communication with a dry side 302 of the bellows module and a movable end disposed in a wet side of the bellows module 304 that comprises a flooded volume 106. In such embodiments, the movable end of each bellows 102 is coupled to at least one actuator 300, in embodiments a linear actuator, configured to expand and/or contract the bellows 102 within the flooded volume, displacing fluid therefrom and increasing buoyancy.

In embodiments, each of the at least one bellows 102 is disposed in a guide tube 306 that restrains each bellows 102 from unwanted lateral movement.

In embodiments, the actuator(s) 300 are controlled by a control module 108 that comprises a processor and non-transitory storage medium configured to cause the actuator(s) 300 to expand or contract the bellows 102. In embodiments, such control is enacted in response to a control signal, which may be generated by a sensor in response to environmental conditions, mechanical conditions of the bellows module or UV, control signals provided by a user, who may be a remote user of a UUV to which the bellows module 100 is affixed, or other type of signal, whether wired or wireless, as would be known to one of ordinary skill in the art.

Now referring to FIGS. 4A and 4B an exemplary submersible vehicle 400 including a low pressure reservoir embodiment of the present disclosure and showing exemplary locations where the bellows modules 100 may be located thereon is depicted. In embodiments, the high-pressure accumulator embodiment or bellows piston embodiment may instead be used, as would be apparent to one of ordinary skill in the art.

Additionally, bellows modules 100 can be placed generally along any axis over which control is desired, with the bellows modules 100 exerting more control, for a given size, the farther out from the center of gravity of any particular axis they are. For example, bellows module 100 may be placed along a longitudinal centerline of a submersible vehicle 400 to obtain pitch control and laterally spaced apart from the longitudinal centerline to obtain heave control, with embodiments that combine both placements using separate bellows modules 100 providing for independent heave and pitch control.

In embodiments, the bellows modules 100 are not positioned directly on a particular axis, but instead between axis. In embodiments, the bellows modules 100 are contained inside a submersible vehicle 400 while in other embodiments they are external to a submersible vehicle 400.

Embodiments of the present disclosure are applicable to any vehicle diameter and at any depth. In addition to vehicle applications, embodiments can also be used to anchor arbitrary payloads on the seabed, to raise them above the water line, and/or to keep them at an arbitrary point along the water column.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

What is claimed is:

1. A variable-buoyancy system comprising:

at least one bellows module, the at least one bellows module comprising:

a pressure vessel comprising a flooded volume and at least one bellows; and a pump in operative communication with the flooded volume and in further operative communication with an environment external to the at least one bellows module via a fluid passage between the environment external to the at least one bellows module and the flooded volume in which a valve configured to allow the fluid passage to be opened or sealed is disposed, wherein the at least one bellows comprises one moveable end and one fixed end, the fixed end being affixed to an interior of the pressure vessel, wherein an interior of the at least one bellows defines a volume sealed from the flooded volume, wherein the pump and valve are configured to convey a fluid between the environment external to the at least one bellows module and the flooded volume, wherein when the pump and valve convey fluid from the environment external to the at least one bellows module to the flooded volume, the at least one bellows contract, wherein when the pump and valve convey fluid from the flooded volume to the environment external to the at least one bellows module, the at least one bellows to expand, and wherein the at least one bellows is an edge-welded metal bellows.

2. The variable-buoyancy system of claim 1, further comprising a sensor disposed within the at least one bellows, the sensor configured to measure an expansion of the at least one bellows.

3. The variable-buoyancy system of claim 2, wherein the bellows module further comprises a control module configured to receive information from the sensor and to control the pump and the valve in response to a control signal.

4. The variable-buoyancy system of claim 1, wherein the bellows module further comprises a filter disposed between the valve and the environment external to the at least one bellows module.

5. The variable-buoyancy system of claim 1, wherein the at least one bellows comprises a plurality of bellows.

6. The variable-buoyancy system of claim 1, wherein the at least one bellows module comprises a plurality of bellows modules.

7. An underwater vehicle comprising the variable-buoyancy system of claim 6, wherein each of the plurality of bellows modules is located on the underwater vehicle such that independent control thereof provides for pitch and/or heave control of the underwater vehicle.

8. The underwater vehicle of claim 7, wherein the plurality of bellows modules are located and oriented to allow for independent heave and pitch control.

9. The variable-buoyancy system of claim 1, wherein the interior of the at least one bellows is pressurized using a source of compressed gas, with the pressure being varied during use, vented to an environment internal to an underwater vehicle on which the at least one bellows module is disposed, or charged to a specific pressure, using a compressed gas, and sealed.

10. The variable-buoyancy system of claim 1, wherein the at least one bellows is manufactured from a material selected from the group of materials consisting of Hastelloy®, Inconel®, titanium, stainless steel, AM350, and 316L.

11. A variable-buoyancy system comprising:

at least one bellows module, the at least one bellows module comprising:

a pressure vessel comprising at least one bellows, wherein an interior of the at least one bellows comprises a flooded volume; and a pump in operative communication with the flooded volume and in further operative communication with an environment external to the at least one bellows module via a fluid passage between the environment external to the at least one bellows module and the flooded volume in which a valve configured to allow the fluid passage to be opened or sealed is disposed, wherein the at least one bellows further comprises one moveable end and one fixed end, the fixed end being affixed to an interior of the pressure vessel, wherein the pump and valve are configured to convey a fluid between the environment external to the at least one bellows module and the flooded volume, wherein when the pump and valve convey fluid from the environment external to the at least one bellows module to the flooded volume, the at least one bellows expand, wherein when the pump and valve convey fluid from the flooded volume to the environment external to the at least one bellows module, at least one bellows contract, and wherein the at least one bellows is an edge-welded metal bellows.

12. The variable-buoyancy system of claim 11, further comprising a sensor disposed within the pressure vessel, the sensor configured to measure an expansion of the at least one bellows.

13. The variable-buoyancy system of claim 12, wherein the bellows module further comprises a control module configured to receive information from the sensor and to control the pump and the valve in response to a control signal.

14. The variable-buoyancy system of claim 11, wherein the bellows module further comprises a filter disposed between the valve and the environment external to the at least one bellows module.

15. The variable-buoyancy system of claim 11, wherein the at least one bellows comprises a plurality of bellows.

16. The variable-buoyancy system of claim 11, wherein the at least one bellows module comprises a plurality of bellows modules.

17. An underwater vehicle comprising the variable-buoyancy system of claim 16, wherein each of the plurality of bellows modules is located on the underwater vehicle such that independent control thereof provides for pitch and/or heave control of the underwater vehicle.

18. The underwater vehicle of claim 17, wherein the interior of the pressure vessel is pressurized using a source of compressed gas, with the pressure being varied during use, vented to an environment internal to an underwater vehicle on which the at least one bellows module is disposed, or charged to a specific pressure, using a compressed gas, and sealed.

19. The variable-buoyancy system of claim 11, wherein the at least one bellows is manufactured from a material selected from the group of materials consisting of Hastelloy®, Inconel®, titanium, stainless steel, AM350, and 316L.

20. A variable-buoyancy system comprising:

at least one bellows module, the at least one bellows module comprising:

a wet side, open to an external environment of the at least one bellows module;

a dry side, sealed from the external environment of the at least one bellows module;

at least one bellows disposed in a guide tube; and at least one actuator operatively coupled to each of the at least one bellows, wherein each of the at least one actuators is configured to expand and/or contract at least one bellows in response to a control signal, wherein the at least one actuators are disposed in the dry side of the at least one bellows module, and wherein an interior volume of the at least one bellows is open to the dry side of the at least one bellows module, wherein the at least one actuator is configured to expand and/or contract the at least one bellows in response to a control signal, and wherein the at least one bellows is an edge-welded metal bellows.

* * * * *